US011976647B2

(12) United States Patent
Daniels et al.

(10) Patent No.: US 11,976,647 B2
(45) Date of Patent: May 7, 2024

(54) COMPRESSOR OR PUMP EQUIPPED WITH A CONTROL FOR THE REGULATION OF THE WORKING RANGE AND WORKING METHOD APPLIED FOR THE REGULATION

(71) Applicant: ATLAS COPCO AIRPOWER, NAAMLOZE VENNOOTSCHAP, Wilrijk (BE)

(72) Inventors: Ivo Daniels, Wilrijk (BE); Antoon Stuer, Wilrijk (BE)

(73) Assignee: ATLAS COPCO AIRPOWER NAAMLOZE VENNOOTSCHAP, Wilrijk (BE)

( * ) Notice: Subject to any disclaimer, the term of this patent is extended or adjusted under 35 U.S.C. 154(b) by 664 days.

(21) Appl. No.: 17/268,640

(22) PCT Filed: Aug. 27, 2019

(86) PCT No.: PCT/IB2019/057204
§ 371 (c)(1),
(2) Date: Feb. 16, 2021

(87) PCT Pub. No.: WO2020/044231
PCT Pub. Date: Mar. 5, 2020

(65) Prior Publication Data

US 2021/0172436 A1 Jun. 10, 2021

(30) Foreign Application Priority Data

Aug. 29, 2018 (BE) ..... 2018/5604

(51) Int. Cl.
*F04B 49/06* (2006.01)
*F04B 49/02* (2006.01)

(52) U.S. Cl.
CPC ..... *F04B 49/065* (2013.01); *F04B 49/022* (2013.01); *F04B 2203/0209* (2013.01)

(58) Field of Classification Search
CPC ..... F04B 49/065; F04B 49/022; F04B 2203/0209; F04B 49/06; F04B 49/02
See application file for complete search history.

(56) References Cited

U.S. PATENT DOCUMENTS 7,442,012 B2 * 10/2008 Moens ..... F04C 28/08 417/18
9,677,556 B2 † 6/2017 Worden
(Continued)

FOREIGN PATENT DOCUMENTS

EP 3156651 A1 4/2017

OTHER PUBLICATIONS

International Search Report in corresponding PCT Application No. PCT/IB2019/057204, dated Nov. 8, 2019.
(Continued)

*Primary Examiner* — Mohammad Ali
*Assistant Examiner* — Sheela Rao
(74) *Attorney, Agent, or Firm* — BACON & THOMAS, PLLC

(57) ABSTRACT

A compressor or pump, including at least one compressor or pump element for pressurised supply of a fluid to a network of consumers of such pressurised fluid; a motor coupled with the compressor or pump element. The compressor or pump is equipped with a control having a basic control for the nominal regulation of one or more control parameters (Q, pw) as a function of a desired, set working point of the compressor within the nominal set working range of the compressor or pump, set during design. The control is further provided with an additional control function for static or dynamic adjustment of the working range limit values. The nominal control range of one or more control
(Continued)

parameters is adjusted as a function of the actual working conditions of the compressor or pump that deviate from the nominal working conditions.

20 Claims, 5 Drawing Sheets

(56) References Cited

U.S. PATENT DOCUMENTS

| | | | | |
|---|---|---|---|---|
| 2010/0106458 | A1 | 4/2010 | Leu et al. | |
| 2013/0236331 | A1* | 9/2013 | Hutchinson | F04C 28/08 417/22 |
| 2017/0314548 | A1* | 11/2017 | Graf | F04B 49/065 |

OTHER PUBLICATIONS

International Preliminary Report on Patentability in corresponding PCT Application No. PCT/IB2019/057204, dated Oct. 28, 2020.

* cited by examiner
† cited by third party

COMPRESSOR OR PUMP EQUIPPED WITH A CONTROL FOR THE REGULATION OF THE WORKING RANGE AND WORKING METHOD APPLIED FOR THE REGULATION

The invention relates to a compressor or pump equipped with an additional control for the static or dynamic control of the limit values of the working range in function of one or more working parameters.

BACKGROUND OF THE INVENTION

Hereafter, the invention is mainly described for compressors, but entirely analogous, the invention also relates to pumps, where a pump serves to pressurize a liquid or liquid mixture in the same manner as a compressor serves for the compression of a gas or gas mixture.

Such compressors and pumps are sufficiently well known as being composed of at least one compressor or pump element for pressurised supply of a fluid to a network of consumers of such pressurised fluid and of a motor coupled to the compressor or pump element.

The expression "working parameter" hereby includes every parameter of the machine and its environment that has an influence on the operation of the compressor or pump. Examples of such working parameters for a compressor are the altitude at which the compressor is used, the outside temperature, the pollution of the air filters, the load of the motor, the power surplus of the available motor power as compared to the required power, and the like.

In general, compressors are equipped with a basic control whereby the flow is regulated to maintain a set desired working pressure or whereby the working pressure is regulated to maintain a set desired flow rate.

Hereafter, flow and working pressure will be referred to as the main control parameters.

The working pressure is easy to measure and thus regulate.

However, the flow rate is more difficult to measure and therefore also harder to regulate directly. Therefore, for the regulation of the flow rate, two underlying control parameters, which are easier to measure and regulate, are used which together determine the flow rate, namely:

on the one hand, the rotational speed; and, on the other hand, the inlet pressure at the inlet of the compressor or the control pressure which is used to control certain auxiliary functions in the compressor such as lubrication, opening of the inlet valve, and the like.

The main control parameters and the underlying control parameters are collectively called the control parameters, each with a certain regulation range between a minimum and maximum value of the corresponding control parameter.

The working range is determined by the minimum and maximum limits of all control parameters, whereby more specifically the nominal working range is determined by the nominal control range of the control parameters in nominal conditions which are determined by specific selected nominal reference values of the working parameters such as altitude, cooling and other influences.

A working point is a set of specific values of the control parameters within the working range.

In fact, a compressor or pump is dimensioned in the design stage and assembled in order to be able to operate within a certain nominal working range which is thus determined by maximum and minimum allowed values of the control parameters of the compressor or pump. These maximum and minimum values are determined by the working parameters of the motor, on the other hand, and the compressor or pump element on the other.

Typically, such a compressor or pump is provided with a basic control for the regulation of one or more control parameters in function of a desired, set working point of the compressor within a nominal set working range of the compressor, set during design.

In practice, such basic regulation is carried out as a dynamic regulation of a chosen control parameter top keep another control parameter constant in the nominal working range.

A widely applied basic regulation consists of, in a compressor or variable flow pump, maintaining the working pressure of the compressor element, or in other words the pressure in the consumer network, as constant as possible by changing the variable flow of the compressor or pump, regardless of the consumption in the consumer network. In Practice, the flow rate regulation is realised by means of two underlying control parameters rotational speed and inlet pressure or control pressure.

If, for example in the case of a compressed air network, the consumption of compressed air increases, the tendency will arise that the pressure in the consumer network will decrease, but thanks to the basic regulation, the pressure will be maintained by increasing the supplied flow of compressed air by increasing the rotational speed of the compressor element and/or increasing the inlet pressure and/or lowering the control pressure within the limits of the nominal set working range.

When the consumption of compressed air decreases, in an analogous manner, the pressure in the consumer network will have the tendency to increase, but because of the basic regulation, the pressure will be maintained by reducing the supplied flow of compressed air by lowering the rotational speed of the compressor element and/or by lowering the inlet pressure and/or by increasing the control pressure, within the limits of the nominal set working range of minimum and maximum limits of the control parameters.

In nominal conditions, the control range of each control parameter such as working pressure, flow rate, rotational speed, inlet pressure and control pressure will be limited between a minimum and a maximum value.

For example, the minimum inlet pressure is determined by the design of the pump or compressor and its inlet valve, to avoid cavitation or high negative forces.

For example, the minimum speed is determined by the torque curve of the motor, by the critical rotational speed of the coupling between motor and compressor or pump element and the minimum rotational speed required to start and to prevent the motor would come to a standstill.

For example, the minimum working pressure is determined by the minimum pressure required for certain auxiliary functions in the compressor, such as lubrication, valve control, . . . .

The maximum inlet pressure is determined by atmospheric pressure and the contamination of the inlet filters.

Maximum rotational speed shall be determined by the maximum available power of the motor that must be at least equal to the maximum absorbed power of the compressor or pump element at the imposed working pressure. The higher the set working pressure, the lower the rotational speed.

The maximum working pressure is determined by the maximum pressure that can be withstand by the components of the compressor.

Due to the uncertainties that exist in terms of the accuracy of the power and torque curves available for the motor and for the compressor or pump element, in practice, at the design stage, usually a power surplus of the motor is opted for, whereby the motor's power is typically 3 to 8% greater than the power of the compressor or pump element in a nominal working point.

In design, the nominal working parameters are chosen such as atmospheric conditions (atmospheric pressure and temperature, sea level, humidity, . . . ) and certain conditions of available cooling capacity for cooling the motor and/or of the compressor or pump element and the condition of the motor and/or of the compressor or pump element (new condition, clean filters, . . . ).

In practice, the working parameters can of course deviate from the nominal working conditions chosen by design, which may result in the aforementioned power surplus falling or even becoming negative, as a result of which the compressor may stop at maximum rotational speed or the compressor can be difficult or impossible to start at the minimum rotational speed, which may be frustrating for the user who does not always realise what is going on and who often experience such situations as the occurrence of an undesirable defect.

For instance, atmospheric conditions that are very different from the nominal working parameters, such as high altitude or extreme cold or hot conditions, may have a negative impact on the power surplus of the motor, which in those cases may even lead to a power deficit or to an unacceptably rapid and radical heating of the compressor or pump with possible damage as a result, or even to an undesirable stoppage of the motor or pump.

Such extreme situations can particularly occur in mobile compressors which need to be able to operate in a variety of working conditions, although also in fixed installations varying working conditions may occur, which may result in lower performance (power, torque) of the motor and inefficient operation of the compressor or pump element.

For example, when a mobile compressor with a combustion engine is deployed at greater heights with thinner air, the motor and compressor performance will change greatly, typically reducing motor power at maximum rotational speed, while the amount of power absorbed by the compressor will also decrease, but not necessarily to the same extent, resulting in lower power overflow and the occurrence of starting problems.

The known compressors and pumps are not equipped with their basic control to address such deviating situations, with all possible adverse effects for the user.

In an analogue manner, the actual working conditions may be more favourable than the nominal working conditions imposed during the design, in which case the power excess of the motor may increase.

However, with classic basic control, this power surplus cannot be utilized usefully, for example to allow for a greater maximum flow rate or an increased working pressure.

SUMMARY OF THE INVENTION

The current invention aims to provide a solution to one or more of the aforementioned and other disadvantages.

To this aim, the invention relates to a compressor or pump, provided with at least one compressor or pump element for delivering a pressurised fluid to a network of consumers of such pressurised fluid; a motor coupled with the compressor or pump element whereby the compressor or pump is designed to operate within an certain nominal working range determined by the nominal control ranges between maximum and minimum allowed control parameters, of the compressor or pump in nominal working conditions and whereby the compressor or pump is equipped with a control with a basic control for the nominal regulation of one or more control parameters in function of a desired set working point of the compressor within the nominal working range set by design, with the characteristic that the control is further provided with an additional control function for the static or dynamic adjustment of the limits of the working range, whereby the nominal control range of one or more control parameters is adjusted as a function of the actual working conditions of the compressor that deviate from the nominal working conditions.

The invention offers the advantage that, when actual working conditions are more unfavourable than the nominal working conditions at design, the control range of the compressor or pump can be adjusted in situ, e.g. by limiting the maximum rotational speed and/or increasing the minimum rotational speed.

In the aforementioned case of a compressor with a combustion engine, the starting problems at high altitude can be resolved or reduced by increasing the minimum speed of the control range of the rotational speed and the problem of the insufficient power surplus can be resolved by reducing the maximum rotational speed and/or the maximum working pressure.

In this manner the compressor can continue to operate even though with reduced performance such as a smaller delivered flow rate or with a lower working pressure.

If, on the other hand, the working conditions are more favourable than imposed upon design, the control range can be increased thanks to the invention, for example, by increasing the maximum rotational speed, such that the larger power surplus that can be achieved, can be applied usefully, for example to realize a greater flow rate or a higher working pressure, depending on the control setting.

The additional control function shall preferably be designed such that the control range of at least one control parameter is reduced, by reducing the maximum limit and/or by increasing the minimum limit of the nominal control range of this control parameter when the actual working conditions deviate in such a way from the nominal working conditions that, without this additional control function:

- the compressor or pump would shut down due to a lack of power of the motor to drive the compressor or pump element or could not be started;
- or the compressor or pump could operate outside of its allowed working range.

In practice, the basic control is generally based on regulating the flow to keep the working pressure constant within a control range limited by a minimum and maximum flow rate and/or based on the regulation of the working pressure to keep the flow rate constant within a control range, delimited by a minimum and maximum working pressure to keep the flow constant.

According to a particular aspect, the compressor or pump control can be provided with set means for setting or measuring at least one working parameter that is not a control parameter, for example, the altitude from sea level, and that the additional control function is such that the control range of one or more control parameters, such as the flow rate, rotational speed, inlet pressure, control pressure, and/or working pressure, is adjusted statically or dynamically as a function of the set or measured value of this working parameter if it deviates from the nominal working conditions, this to prevent that:

the compressor or pump would shut down due to a lack of power of the motor to drive the compressor or pump element or could not be started;

or the compressor or pump could operate outside of its allowed working range.

The control can therefore take into account the impact of working at higher altitude, whereby for example, the altitude can be set via a set button, keyboard, touch screen or the like or can be measured, for example, by in situ measurement of atmospheric pressure.

In addition to the altitude measurement, many other working parameters that may influence the power surplus or a combination thereof can be monitored by the control, such as:

other atmospheric parameters such as temperature, air humidity, or the like;

the available cooling capacity for cooling the compressor or pump;

the temperature of the compressed gas;

the temperature of the cooling of the motor;

the temperature of the turbo of the engine in case of a turbo-equipped combustion engine;

pollution of the air filters of the motor and of the compressor element;

the available energy source or energy sources for driving the compressor or pump;

the available capacity of this energy source or energy sources;

the load of the motor;

the power surplus.

The list above is not limitative.

The altitude is a working parameter that can change in mobile compressors or pumps if the machine moves from one workshop to another. During operation of the compressor or pump, the altitude does not change. Therefore, the influence of the altitude on the working range can be determined when the machine is turned on. The minimum and maximum values of the control range no longer need to be adjusted during operation. We call altitude a static working parameter.

There are also working parameters that can vary during operation, such as cooling or load of the motor. Therefore, the influence of these parameters on the working range needs to be adjusted during operation. Thus the minimum and maximum values of one or more control parameters must be adjusted continuously. We call these dynamic working parameters.

For each static working parameter, it is preferred that the influence of this parameter on the operation of the compressor or pump is known in advance, for example, by calculation or determined experimentally, and that this impact is introduced into the control in the form of a table or curve or of an allowable working range, which allows the control to determine the necessary adjustment of the control range as a function of the set or measured value.

In the case of dynamic working parameters, the additional control function is programmed such that it can adjust the set nominal control range of one or more control parameters such as flow rate, rotational speed, negative pressure in the inlet, control pressure, or working pressure, as a function of the actual value of these dynamic working parameters, such as the cooling capacity.

Preferably, for each dynamic working parameter, the control is provided with an additional control loop, typically a PID, which as function of the deviation as compared to the desired value of the working parameter will dynamically adjust the control range of one or more control parameters.

Modern compressors may be equipped with an electronic basic control that provides the possibility to determine or measure the actual power surplus of the motor in situ.

An advantage of the direct determination of the power surplus is that this does not require all dynamic working parameters to be monitored separately in order to know the influence on the power surplus and that because of this the influence of certain parameters which are not or difficult to determine such as the wear of the compressor or pump, the use of lower quality fuel, pollution of air filters and/or fuel filters, the obstruction of the inlet and outlet etc., are taken into account.

In this case, the power surplus can be seen as a global dynamic working parameter, which allows the additional control function to be controlled.

If in case of a high flow rate the actual power surplus threatens to become lower than a set value or threatens to become negative, the additional control function will preferably reduce the maximum limit of the adjustable flow rate and/or of the controllable working pressure.

If in case of a low flow rate this power surplus threatens to become lower than a set value, the additional control function will preferably increase the minimum limit of the adjustable flow rate and/or decrease the maximum limit of the control range of the working pressure.

The invention is particularly useful for mobile compressors or pumps as these have to be utilized in highly variable environments.

With the term "mobile", reference is made here to a compressor or pump intended to be movable, for example from one yard to another, even if this requires transportation means or lifting equipment. In short, a compressor that is not intended to be used stationary in a fixed place.

The invention also relates to a method for controlling a compressor or pump, comprising at least one compressor or pump element for delivering a pressurised fluid to a network of consumers of such pressurised fluid and a motor, whereby the compressor or pump is designed to operate within a particular working range that is determined by the max and min allowed values of the control parameters of the compressor or pump, whereby the compressor or pump is equipped with a basic control for the nominal control of one or more control parameters within a nominal set control range and this as a function of a desired set control parameter such as flow rate or work pressure or of a desired set working point of the compressor or pump within the nominal working range set by design, with the characteristic that when the actual working conditions deviate from the nominal working conditions or fall outside of the nominal working range of the compressor or pump, an extra control step is added for the static or dynamic adjustment of the nominal control range of one or more control parameters as a function of the actual working conditions of the compressor or pump.

BRIEF DESCRIPTION OF THE DRAWINGS

With the intention of better showing the characteristics of the invention, hereafter, as example and without any limiting character, some preferred embodiments and applications of a compressor according to the invention and a working method applied thereby, are described, with reference to the accompanying drawings, in which.

Figure 1A:
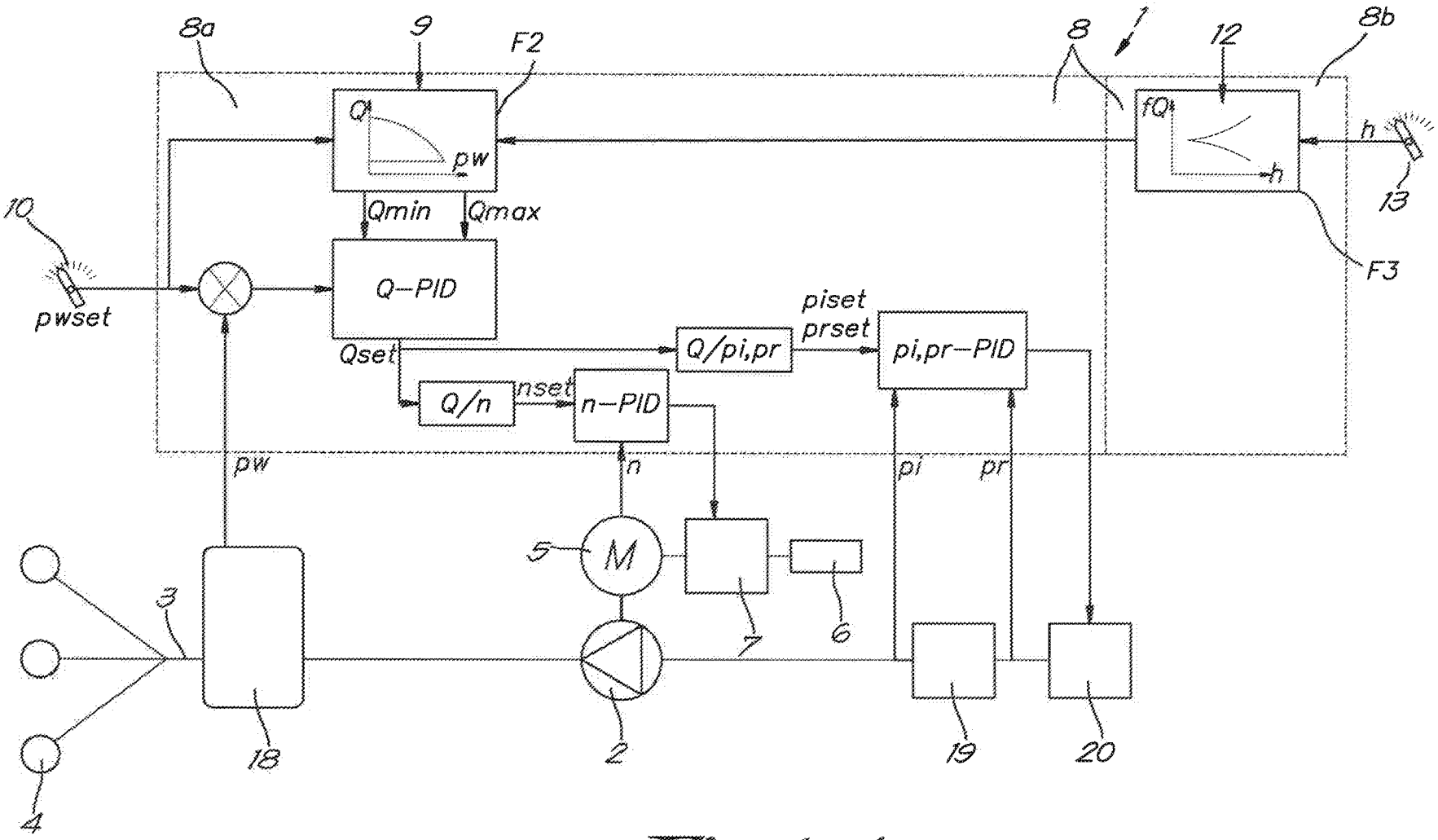
FIG. 1A schematically depicts a compressor according to the invention with a control as a function of a static working parameter.
Figure 1B:
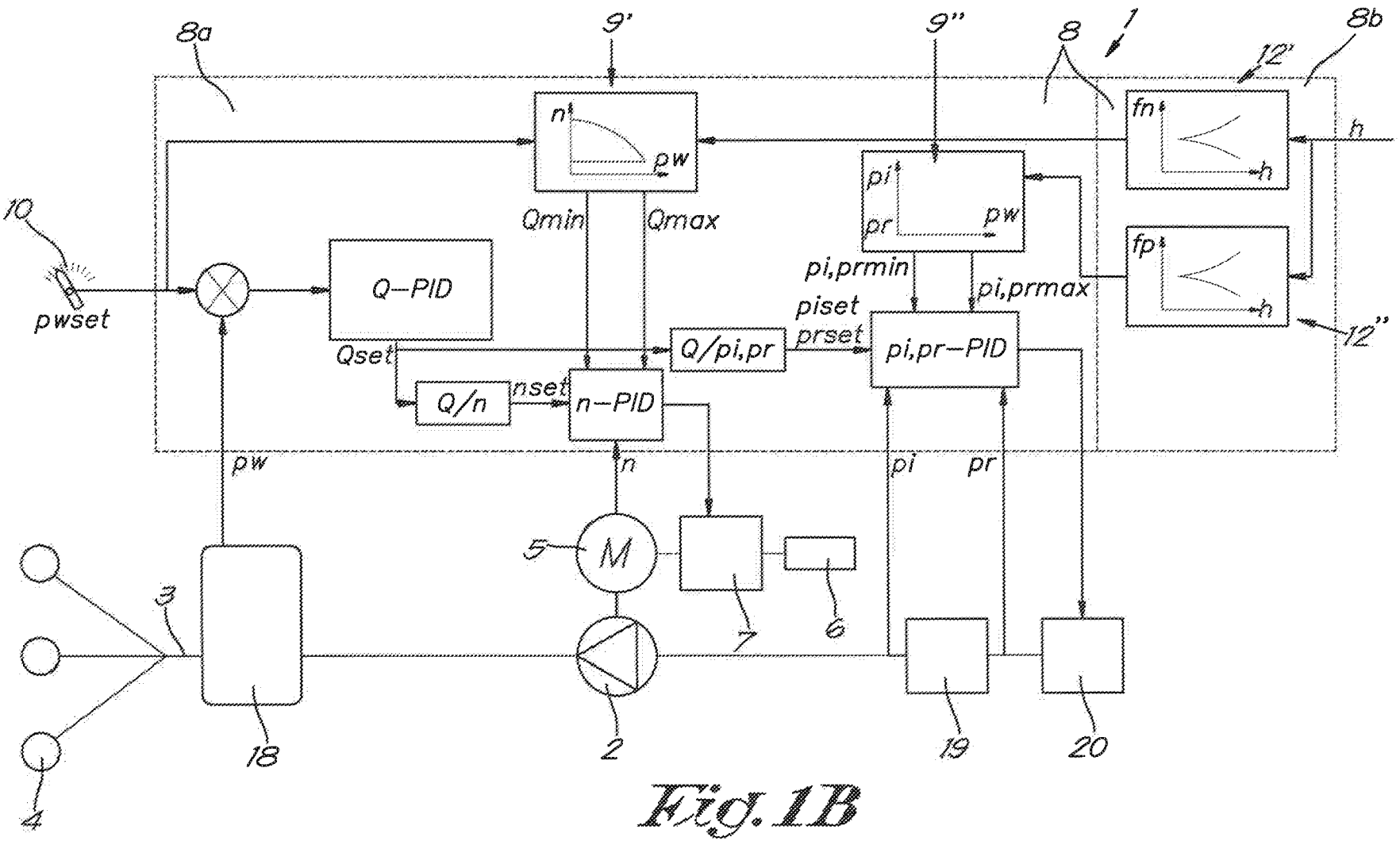
FIG. 1B represents an alternate embodiment of the compressor of FIG. 1A.
Figure 2:
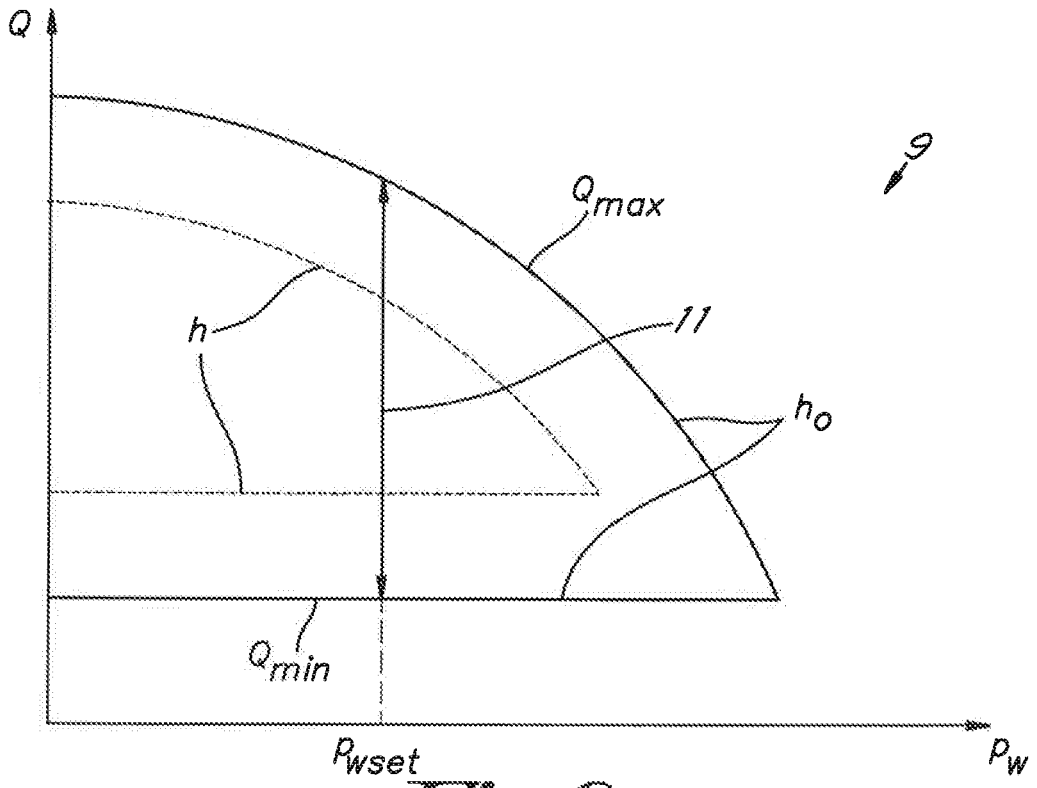
Figure 3:
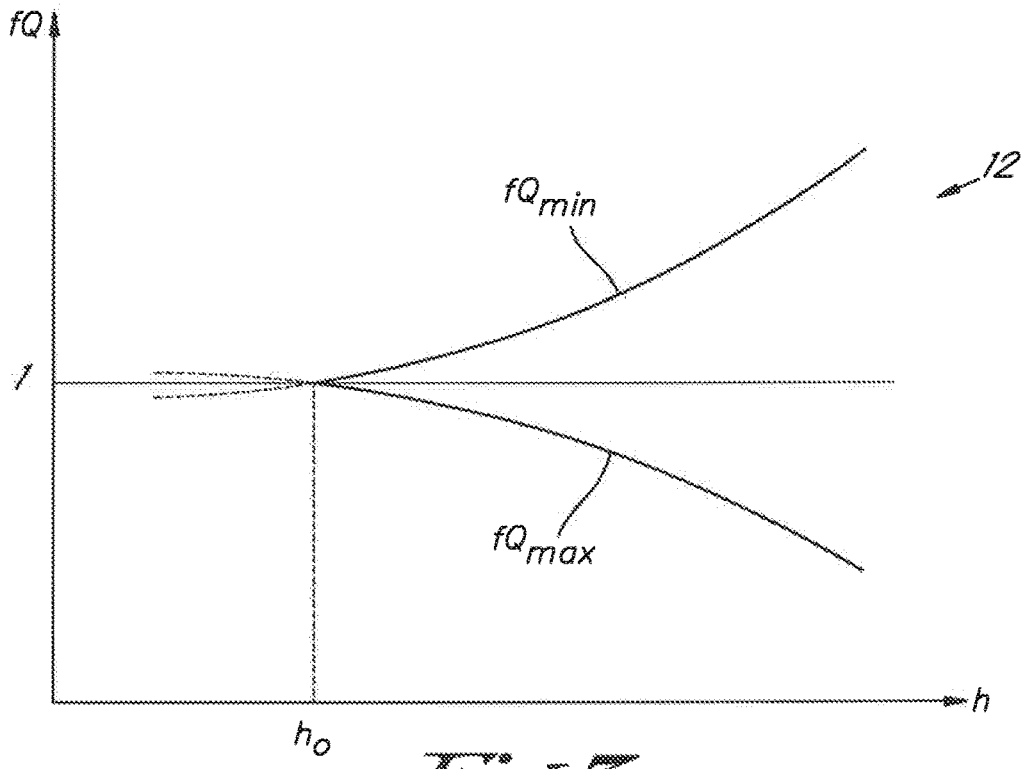
Figure 4:
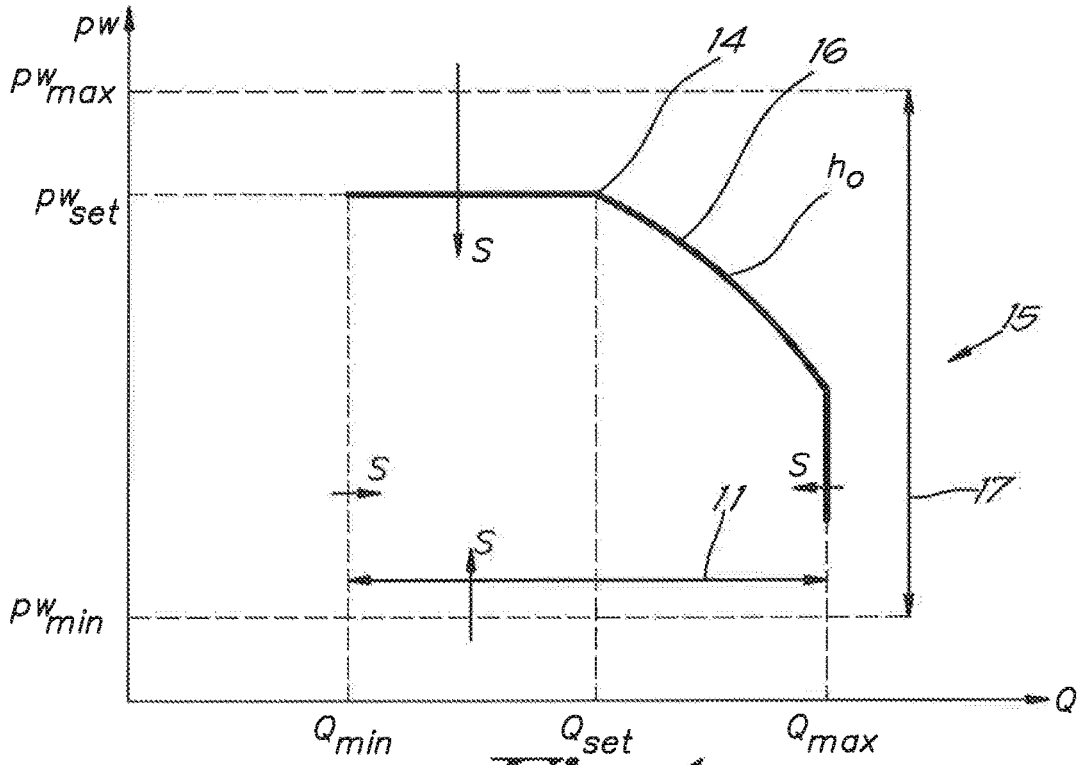
Figure 5:
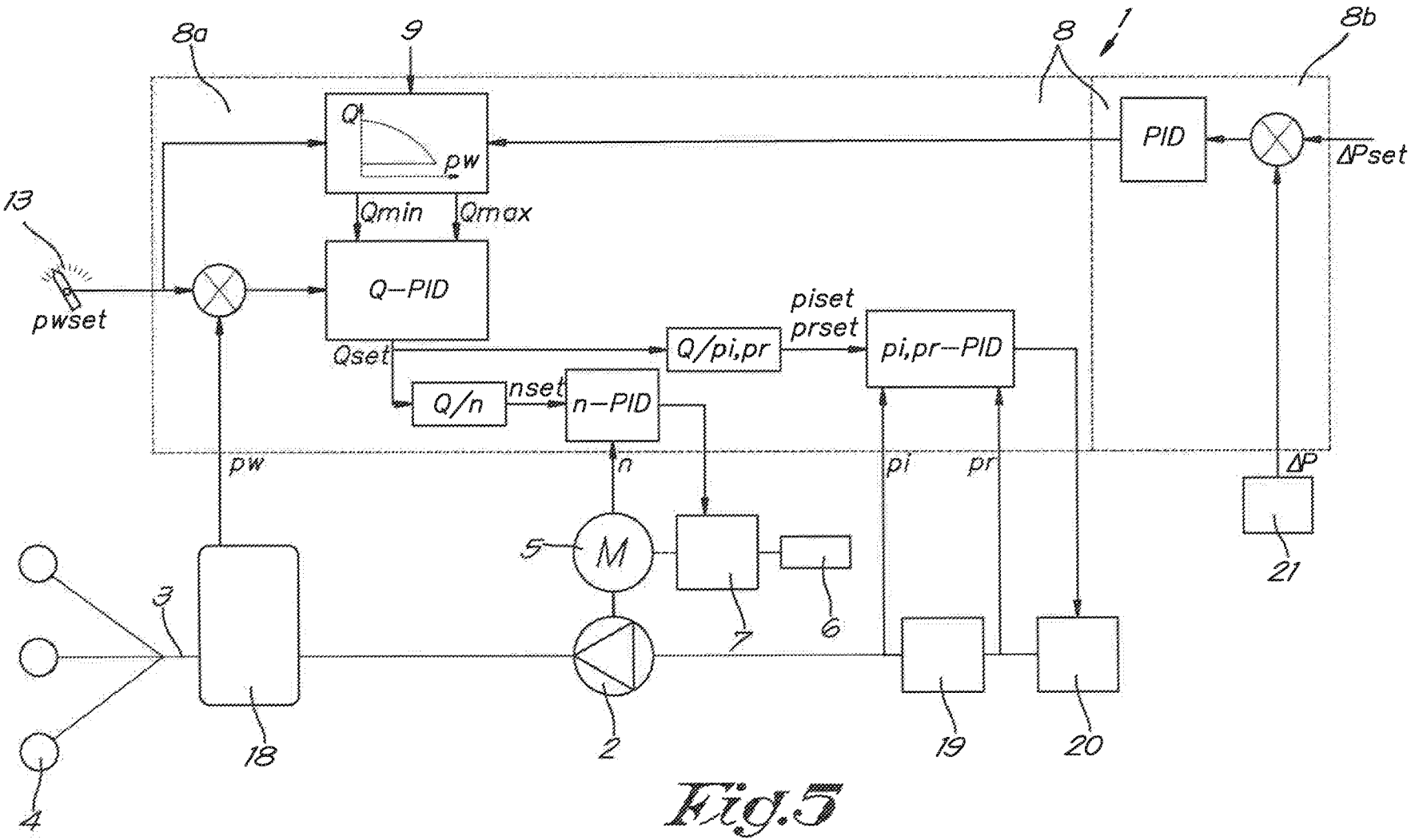

the FIGS. 2 and 3 on a larger scale show two graphs that are indicated in FIG. 1 respectively with F2 and F3;

FIG. 4 depicts an working graph of a compressor according to the invention;

FIG. 5 represents an alternative embodiment of a compressor according to the invention, in this case for a control as a function of a dynamic working parameter.

DETAILED DESCRIPTION OF THE INVENTION

FIG. 1A by way of example, shows a mobile compressor 1 according to the invention comprising at least one compressor element 2 for compressing and delivering of gas to a network 3 of consumers 4 of compressed gas 4; a motor 5 with variable speed n, coupled with the compressor element 2.

The motor 5 is for example a combustion engine with a fuel reservoir 6 and an adjustable injection pump 7 with which the rotational speed n of the motor 5 can be controlled through control 8 in order to be able to operate within a design-imposed working range determined by the minimum and maximum limits of the control parameters such as flow rate Q and working pressure pw, at nominal working conditions determined by working parameters, such as the temperature of the motor 5, temperature of the compressor element 2, temperature of the compressor gas, ambient temperature, etc.

The control 8 comprises a basic control 8*a* configured to control a main control parameter such as the flow rate Q, respectively the working pressure pw, of the compressor or pump, as a function of a set desired pressure pwset or a set flow rate Qset.

In the example of FIG. 1A, the flow rate Q is the main control parameter that is being adjusted to obtain and maintain a constant working pressure pwset, at least within certain limits of minimum flow rate Qmin and maximum flow rate Qmax which are known and entered into the basic control 8*a* as a function of the desired working pressure pwset to be obtained, for example, in the form of a graph 9 as shown in FIG. 2.

The desired working pressure pwset can for example be set by the user via a set button 10.

The flow rate Q to be set is then realised by regulating one or more underlying control parameters, such as rotational speed n and inlet pressure pi or control pressure pr.

The basic control 8*a* is realised for example by a regulation whereby the working pressure pw is measured for example by means of a pressure sensor 18 or the like and whereby the measured working pressure pw is compared to the set pressure pwset and by determining therefrom the desired flow rate Qset determined via a controller Q-PID, from where via a first algorithm Q/n the desired rotational speed nset and via a second algorithm Q/pi,pr a desired inlet pressure piset or a desired control pressure prset are determined.

On the basis of the desired rotational speed nset and of the desired inlet pressure or control pressure values, the rotational speed of the motor 5 is regulated via a regulation n-PID, which for example intervenes with the injection pump 7 and the inlet pressure pi or control pressure pr are regulated using a control pi,pr-PID which for example affects the position of the inlet valve 19 with a control body 20 of the inlet valve.

The basic control 8 will thus increase or decrease the flow rate Q until when the measured working pressure pw is equal to the set working pressure pwset, at least as far as this is possible within the allowable control range 11 of the flow rate Q or the rotational speed n.

This control range 11 is represented by the graph 9 of FIG. 2 in which Qmin and Qmax can be read as a function of the setpoint pwset of the desired pw working pressure pw, whereby for example, for a desired working pressure pwset a control range 11 can be derived as a difference between the curve Qmax and the curve Qmin within which the flow rate Q can be controlled.

The curve Qmax is for example determined by the fact that with Qmax the power absorbed by the compressor element 2 at the set working pressure pwset lies below the maximum power that can be delivered by the motor 5, more specifically the desired power surplus, typically 3 to 8%.

The graph 9 is made at design, departing from the theoretical curves of the motor 5 and of the compressor element 2 in nominal working conditions, such as at a height h0 at sea level.

In addition to basic control 8*a*, the control 8 is further provided with an additional control function 8*b* according to the invention for conducting additional control steps.

When the compressor 1 is used at a higher altitude h above sea level where normally a lower ambient pressure and temperature is observed, then this results in that the actual power of the motor 5 will decrease at this altitude, just like the power absorbed by the compressor element 2 will decrease, but not necessarily to the same extent, as a result of which the power surplus will decrease or even be negative.

This can then result in the motor 5 being stopped when reaching the maximum rotational speed as a result of reaching the maximum flow rate Q of the graph 9 at sea level h0 and difficulty with or inability to start the compressor 1 at the minimum rotational speed as a result of reaching the minimum flow rate Qmin of the graph 9.

To prevent this, according to the invention an additional control function 8*b* is integrated in the control 8 which will adjust the control range 11 of graph 9 by reducing the maximum flow rate Qmax and/or increasing the minimum flow rate Qmin, as a result of which nmax or nmin will be adjusted along. It is also possible to not intervene in the limits of the flow rate Q, but alternatively directly adjust the control range of the rotational speed n, based on the conversion of the flow rate Q to the rotational speed n for a given compressor or pump.

The additional control function 8*b* for example uses a graph 12 as shown in FIG. 3, which gives a correction factor fQ with which Qmax, respectively Qmin, of the graph 9 needs to be multiplied to derive the maximum and minimum flow rate to be applied at the altitude h and at a desired working pressure pwset as shown in dotted line in graph 9 of FIG. 2.

Graph 12 of FIG. 3 shows a correction factor fQmin to be applied for the minimum flow rate Qmin which is greater than 1 for altitudes h above sea level h0 and which increases with the altitude and also a correction factor fQmax to be applied which is smaller than 1 and that decreases with altitude h.

Theoretically, the curves fQmax and fQmin can be extended for altitudes below sea level as shown in dotted line in graph 12 of FIG. 3, whereby the control range 11 of the flow rate can then theoretically be made greater than at sea level h0.

For example, the height h at which the compressor 1 is used can be set by the user using a set button 13 or other means to set the altitude h.

Alternatively, the altitude can be measured or derived from atmospheric pressure measurement.

The graph 12 can be calculated or be determined experimentally in advance, during the development of the compressor 1.

Instead of a continuous curve as shown in graph 12, a table can also be used with discrete values of the correction factor, corresponding to discrete values of the altitude, for example, each time with a height difference of 100 meters.

Instead of the altitude, other static working parameters may be set or measured which may affect the performance of the motor 5 and of the compressor element 2, if deviating from the nominal working conditions.

For each statistic working parameter and for every control parameter, a graph or table can be entered for the correction factor f in the control 8.

In the embodiment of FIG. 1B, instead of adjusting the control range of the flow rate Q, the control range of the underlying control parameters is adjusted directly such as for the rotational speed n and for the inlet pressure pi or control pressure pr, of which the nominal control ranges in the basic control 8*a* are entered in the form of graphs or tables 9' and 9" in function of the working pressure, analogous to the graph 9 for the control range of the flow rate in the embodiment of FIG. 1A.

In the embodiment of FIG. 1B, the additional control function 8*b* contains a correction graph 12' to adjust the control range of the rotational speed n in function of the altitude h and analogue also a correction graph 12" to adjust the control range of the inlet pressure pi or of the control pressure pr to interact directly with the underlying control parameter n and pi or pr.

The graphs 12' and 12" contain a correction factor fn for the control range of the rotational speed in the graph 9' and a correction factor fp for the control range of the inlet pressure pi or the control pressure pr in the graph 9" and this in function of the altitude.

Instead of a control of the flow rate Q, by means of the rotational speed n and inlet pressure pi or control pressure pr to keep the working pressure pw constant, an analogue control can also be applied whereby the working pressure pw is regulated to achieve a constant rotational speed n or flow rate Q. In that case, the correction factor f can be applied to the maximum pressure pmax and the minimum pressure pmin which can be altered in working conditions which deviate from design.

The control can also include both regulations, whereby the choice is left up to the user which of both regulations, flow rate Q or working pressure pw, he wishes to apply.

In modern compressors 1 with an electronic control, even a desired working point 14 can be set as shown in graph 15 of FIG. 4, which working point 14 is defined by a desired flow rate Qset and a desired working pressure pwset in nominal conditions at design, for example at sea level h0.

At sea level h0, with a control by means of only a basic control 8*a*, in other words without additional control function 8*b*, the working point 14 will follow the curve 16 shown in bold in FIG. 4 and this within a nominal set control range 11 of the flow rate Q limited by Qmax and Qmin. The working point can be changed by the user by changing the desired working pressure pwset within an imposed nominal control range 17 of the working pressure pw delimited by pwmax and pwmin.

The additional control function 8*b* will, in case when using the compressor at higher altitudes, adjust these limit values Qmin, Qmax of the control range 11 and pwmin, pwmax of the control range 17, as shown by the arrows S in FIG. 4. As a result, the working range and thus the choice of the desired working point will decrease.

In a variant embodiment of a compressor 1 according to FIG. 5, the control range of the flow rate Q is dynamically controlled in function of a dynamic working parameter that can constantly change and for which no predefined correction graph can be applied such as in the case of altitude.

In the case of FIG. 5, by way of example, a dynamic control is applied in function of the power surplus ΔP as a working parameter, which power surplus ΔP is the difference between the available power of the motor 5 and the power required by the compressor element 2 and can be determined using means 21 of which the signal is linked back to the additional control function 8*b*.

In the additional control function 8*b* a desired value ΔPset of the power surplus ΔP is set, for example a ΔPset of 2%.

The additional control function 8*b* will then compare the actual power surplus ΔP from the means 21 to the desired value ΔPset and if this value differs from the desired value, the additional control function 8*b* will adjust the limit values of one or more control parameters to achieve the desired power surplus.

In this case, the additional control function 8*b* will use a regulation, typically PID, to maintain the power excess at a certain level by changing the limit values of the compressor working range, e.g. adjusting the control range 11 of the flow rate.

The current invention is not restricted to the embodiments described as an example and shown in the drawings, but a compressor or pump and method according to the invention can be applied in a variety of forms and dimensions without going outside of the scope of the invention.

The invention claimed is:

1. A compressor or pump, comprising at least one compressor or pump element for pressurised supply of a fluid to a network of consumers of such pressurised fluid, a motor coupled with the compressor or pump element, wherein the compressor or pump is designed to operate within a certain nominal working range determined by a control range between maximum and minimum allowed values of at least one of a plurality of control parameters of the compressor or pump in nominal working conditions, and wherein the compressor or pump is equipped with a control having a basic control for regulation of the control parameters as a function of a desired, set working point of the compressor within the nominal set working range of the compressor or pump, set during design, wherein the control parameters include a working pressure of the compressor or pump, and/or an inlet pressure of the compressor or pump, and wherein the control is further provided with an additional control function for static or dynamic adjustment of the maximum and/or minimum allowed values of at least one of the control parameters wherein the nominal control range of one or more control parameters is adjusted as a function of an actual working condition of the compressor or pump that deviates from one of the nominal working conditions.

2. The compressor or pump according to claim 1, wherein a nominal power of the motor is greater than a nominal power of the compressor or pump element in nominal design conditions.

3. The compressor or pump according to claim 2, wherein the control parameters further include a rotational speed of the motor, and wherein said additional control function is such that the control range of said at least one of the control parameters is reduced by lowering of the maximum limit and/or by increasing the minimum limit of the control range of said at least one of the control parameters when the actual working conditions deviate from the nominal working conditions in such a way that without said additional control function:

the compressor or pump would stop due to a lack of power of the motor to be able to drive the compressor or pump element, or a failure of the motor to be started;

or the compressor or pump could operate outside of its permitted working range.

4. The compressor or pump according to claim 3, wherein the compressor or pump is equipped with an adjustable variable rotational speed (n), adjustable flow rate, and/or adjustable working pressure (pw), and the basic control is equipped to control the flow rate (Q) by controlling said one of the control parameters, and/or to control the working pressure (pw) within a set nominal control range limited by a set nominal minimum and maximum working pressure (pwmin and pwmax), and the additional control function is provided for controlling one or more of the control ranges.

5. The compressor or pump according to claim 4, wherein the control is equipped with means to determine the power surplus of the available power of the power relative to the absorbed power of the compressor or pump element in actual working conditions, and said additional control function is such that it adjusts the set nominal working or control range of the flow rate (Q) by means of said at least one of the control parameters as a function of a power surplus.

6. The compressor or pump according to claim 5, wherein the control parameters further include a rotational speed of the motor, and wherein when said power surplus threatens to become smaller than a set value in case of a high rotational speed (n) or flow rate (Q), a maximum limit (nmax or Qmax, pwmax) of the flow rate and/or of the working pressure (pw) is reduced.

7. The compressor or pump according to claim 5, wherein the control parameters further include a rotational speed of the motor, and wherein when said power surplus threatens to become less than a set value in case of a low rotational speed (n) or flow rate (Q), a minimum limit (nmin or Qmin) of the control range of the rotational speed (n) or the flow rate (Q) is increased and/or a maximum limit (pwmax) of the control range of the working pressure (pw) is reduced.

8. The compressor or pump according to claim 1, wherein the control parameters further include a rotational speed of the motor, and wherein the control is equipped with set means for setting or measuring of at least one working condition and the additional control function is such that the maximum and/or minimum allowed values of said at least one of the control parameters is adjusted statically or dynamically as a function of the set or measured value of the at least one working condition if it deviates from the nominal working conditions, to prevent that:

the compressor or pump would stop due to a lack of power of the motor to be able to drive the compressor or pump element, or a failure of the motor to be started;

or the compressor or pump could operate outside of its permitted working range.

9. The compressor or pump according to claim 8, wherein said settable or measured working condition is a condition or a combination of conditions from the following list:

atmospheric conditions selected from altitude atmospheric pressure, atmospheric temperature, or atmospheric humidity;

available cooling capacity for cooling the compressor or pump;

a temperature of compressed gas;

a temperature of a cooling of the motor;

a temperature of a turbo of the motor in case of a turbo-equipped combustion motor;

availability of energy sources for driving the compressor or pump;

available capacity of said energy source or energy sources;

a load of the motor.

10. The compressor or pump according to claim 8, wherein the additional control function for static adjustment of maximum and/or minimum allowed values of at least one of the control parameters includes a table or graph from which the adjustment of the control range to be applied by the additional control function is derived as a function of the value of the working parameter to be set or measured.

11. The compressor or pump according to claim 8, wherein the additional control function for dynamic adjustment of the maximum and/or minimum allowed values of at least one of the control parameters includes a control loop, typically PID, that will dynamically adjust the control range of one or more control parameters in function of the deviation relative to the desired value of the working parameter.

12. The compressor or pump according to claim 1, wherein it compressor or pump is a mobile compressor or pump.

13. A method for controlling a compressor or pump, containing at least one compressor or pump element for pressurised supply of a fluid to a network of consumers of such pressurised fluid and a motor, wherein the compressor or pump is designed to operate within a certain nominal working range determined by maximum and minimum allowed values of at least one of a plurality control parameters of the compressor or pump control, wherein the compressor or pump is equipped with a control having a basic control for regulation of the control parameters within a nominal set control range and as a function of a desired, set control parameter or of a desired, set working point of the compressor within the nominal set working range of the compressor, set during design, wherein the control parameters include, and wherein the method comprises a step of:

when the actual working conditions deviate from the nominal working conditions or lie outside the nominal working range of the compressor or pump, applying an additional control step for static or dynamic adjustment of the nominal control range of at least one of the control parameters as a function of actual working conditions of the compressor or pump.

14. The method according to claim 13, wherein the method is applied to a compressor or pump with a motor whose nominal power is greater than a nominal power of the compressor or pump element in nominal design conditions.

15. The method according to claim 14, wherein said additional control step reduces the control range of at least one of the control parameters by reduction of the maximum allowed value and/or by increasing the minimum allowed value of the nominal control range of said at least one of the control parameters when the actual working conditions deviate from the nominal working conditions in such a way that without said additional control step:

the compressor or pump would stop due to a lack of power of the motor to be able to drive the compressor or pump element, or a failure of the motor to be started;

or the compressor or pump could operate outside of its permitted working range.

16. The method according to claim 15, wherein the method is applied to a compressor or pump with a variable flow rate (Q) and/or with a controllable working pressure (pw), wherein the basic control is equipped to control the flow rate (Q) or the working pressure (pw) by controlling one of the control parameters and/or to control the working pressure (pw) within a set nominal control range limited by a minimum and maximum pressure (pwmin and pwmax) and wherein one or more of the control ranges are controlled in the additional control step.

17. The method according to claim 16, wherein before the additional control step, a power surplus of the available power of the motor is determined relative to an absorbed power of the compressor or pump element, and wherein a set nominal control range of the flow rate (Q) or a control range of the working pressure (pw) is adjusted as a function of said power surplus by means of said at least one of the control parameters.

18. The method according to claim 17, wherein when said power surplus threatens to become less than a set value in case of a high rotational speed (n) or flow rate (Q), the additional control step consists of reducing a maximum limit (nmax, Qmax, pwmax) of the rotational speed (n) the flow rate (Q), and/or the working pressure (pw).

19. The method according to claim 17, wherein when said power surplus threatens to become less than a set value in case of a low rotational speed (n) or flow rate (Q), the additional control step includes a step of raising a minimum limit (nmin, Qmin) of the control range of the rotational speed (n) or of the flow rate (Q) and/or reducing the maximum limit (pwmax) of the control range of the working pressure.

20. The method according to claim 13, wherein said method comprises a step of monitoring at least one working parameter and the additional step comprises a step of adjusting the control range of at least one of the control parameters as a function a value or condition of said monitored working parameter when the value or condition deviates from the nominal working conditions to prevent the compressor or pump from stopping due to a lack of power of the motor to be able to drive the compressor or pump element, or in case the motor could not be started;

or to prevent the compressor or pump from operating outside of a permitted working range.

* * * * *